United States Patent [19]

Malvick

[11] Patent Number: 4,477,818

[45] Date of Patent: Oct. 16, 1984

[54] DEPLOYMENT MECHANISM FOR AN ELECTRONIC ARRAY

[75] Inventor: David L. Malvick, Newbury Park, Calif.

[73] Assignee: The United States of America as represented by the Secretary of the Navy, Washington, D.C.

[21] Appl. No.: 419,364

[22] Filed: Sep. 16, 1982

[51] Int. Cl.[3] ..... H01Q 1/34; H01Q 1/08

[52] U.S. Cl. ..... 343/881; 343/709

[58] Field of Search ..... 343/705, 708, 709, 761, 343/880, 881, 882

[56] References Cited

U.S. PATENT DOCUMENTS

| | | | |
|---|---|---|---|
| 2,763,002 | 9/1956 | Fitzgerald et al. | 343/880 |
| 2,796,268 | 1/1955 | Larson | 287/14 |
| 2,953,400 | 9/1960 | Miller | 287/1 |
| 3,290,642 | 11/1966 | Mason | 340/2 |
| 3,315,918 | 4/1967 | Schwerdtfeger et al. | 343/705 |
| 3,447,157 | 5/1969 | Tranin | 343/705 |
| 3,529,850 | 3/1969 | Montalto | 280/150.5 |
| 3,566,346 | 2/1971 | Scopatz | 340/8 |
| 3,928,952 | 12/1975 | Whyte | 52/110 |
| 4,115,784 | 12/1978 | Schwerdtfeger et al. | 343/915 |

*Primary Examiner*—Eli Lieberman

*Attorney, Agent, or Firm*—R. F. Beers; Francis I. Gray

[57] ABSTRACT

A deployment mechanism automatically deploys stave-like electronic sensing units in a circular array and locks the sensing units in position. One end each of an upper and of a lower arm are pivotally connected to a stave-like sensing unit. The other end of the upper arm is pivotally connected to a central supporting electronic unit via a band having tabs. The other end of the lower arm is connected via a hinge support and spring to the central unit. The spring provides the power to rotate the arms down, forming the array segment. The spring also translates the lower arm into a slot in the hinge support to lock the lower arm and, thus, the sensing unit in position.

8 Claims, 3 Drawing Figures

DEPLOYMENT MECHANISM FOR AN ELECTRONIC ARRAY

BACKGROUND OF THE INVENTION

1. Field of the Invention

The present invention relates to deployment mechanisms, and more particularly to a mechanism for automatic deployment of a stave-like electronic sensing unit.

2. Description of the Prior Art

A plurality of stave-like electronic sensing units are arranged into a circular pattern to form an array. These sensing units are folded up along the side of a supporting electronic unit and stowed in a tube prior to deployment. It is desired that when the tube is removed, the electronic sensing units are automatically deployed in their array configuration and locked into place to maintain the array diameter against external forces such as water flow.

SUMMARY OF THE INVENTION

Accordingly, the present invention provides a deployment mechanism for automatically deploying stave-like electronic sensing units in a circular array and locking the sensing units in position. One end each of an upper and of a lower arm are pivotally connected to a stave-like sensing unit. The other end of the upper arm is pivotally connected to a central supporting electronic unit via a band having tabs. The other end of the lower arm is connected via a hinge support and spring to the central unit. The spring provides the power to rotate the arms down, forming the array segment. The spring also translates the lower arm into a slot in the hinge support to lock the lower arm and, thus, the sensing unit in position.

Therefore, it is an object of the present invention to provide a mechanism for automatically deploying a plurality of stave-like electronic sensing units into a circular array and for locking the sensing units in position.

Other objects, advantages and novel features of the present invention will be apparent from the following detailed description when read in conjunction with the appended claims and attached drawing.

DESCRIPTION OF THE PREFERRED EMBODIMENT

Figure 1:
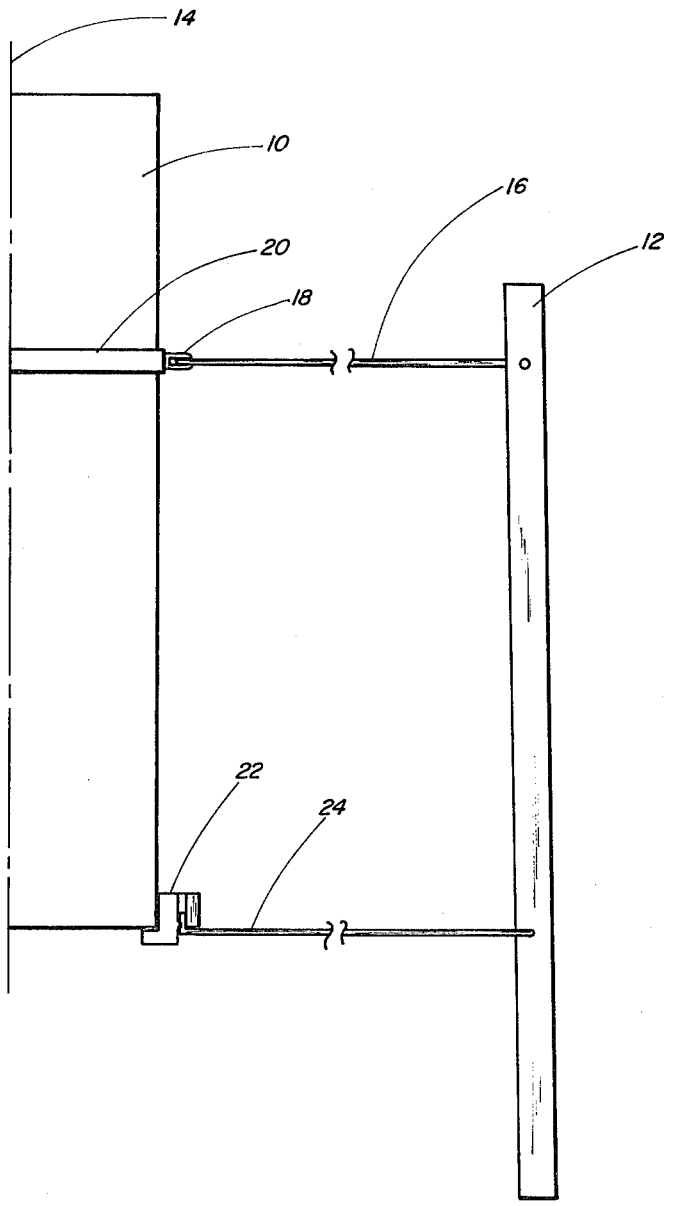
FIG. 1 is a pictorial view of a deployment mechanism according to the present invention.

Referring to FIG. 1 a central, generally cylindrical, electronic unit 10 has a plurality of staves 12 (only one shown) which are deployed in a circular array about a central axis 14. The stave 12 when deployed or when stowed along the central electronic unit 10 lies parallel to the central axis 14. An upper arm 16 is pivotally connected at one end to the upper portion of the stave 12 and at the other end to a tab 18 on a band 20 secured around the middle of the central electronic unit 10. A hinge support 22 is attached by any suitable means to the bottom of the central electronic unit 10. A lower arm 24 is pivotably connected at one end to the lower portion of the stave 12 and at the other end to the hinge support 22. The cooperation between the lower arm 24 and the hinge support 22 provides the driving mechanism for automatically deploying the stave 12 from its stowed position.

Figure 2:
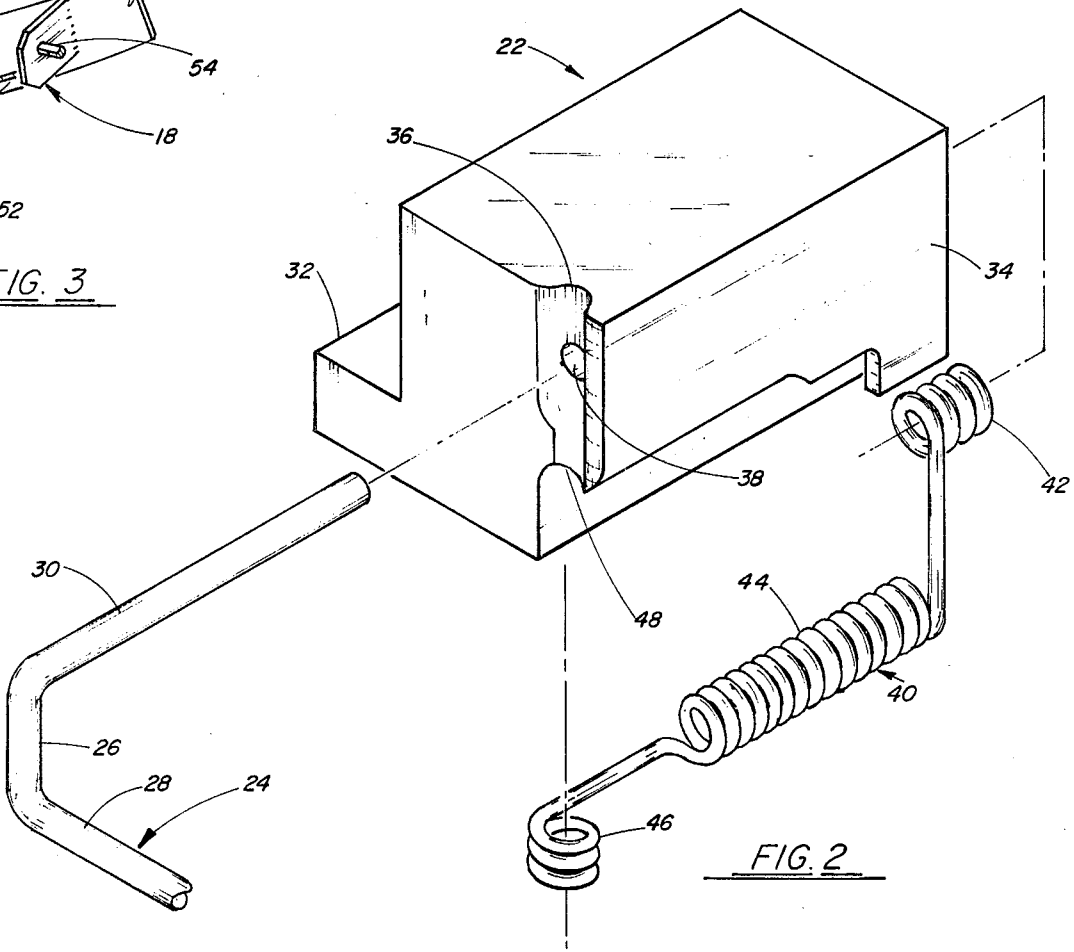
FIG. 2 is an exploded perspective view of the hinge support, spring and end of the lower arm of the deployment mechanism.

As shown in FIG. 2 the end of the lower arm 22 which connects to the hinge support 22 has a unique configuration. A short mid portion 26 of the lower arm 24 is orthogonal to the main portion 28 of the lower arm. An end portion 30 is orthogonal to both the mid portion 26 and the main portion 28 of the lower arm 24. The hinge support 22 has a flange portion 32 which fits against the bottom of the central electronic unit 10. The main portion, or body 34, of the hinge support 22 contiguous to the flange 32 is contoured to fit closely against the surface of the central electronic unit 10. A vertical slot 36 in the body 34 has an orthogonal horizontal hole 38 which extends through the body from the slot. The source of the driving force is a three-part spring 40. A short end portion 42 is offset from a longer main portion 44, the axes of the two portions being parallel. An attachment portion 46 at the end of the main portion 44 provides means for attaching the spring 40 to the mid portion 26 of the lower arm 24. The short portion 42 slips over the end of the end portion 30 of the lower arm 24 after the end portion has been inserted through the hole 38 in the hinge support 22. The main body 44 of the spring 40 rests in a groove 48 underneath the body 34 of the hinge support 22 orthogonal to the slot or retaining groove 36 and parallel to the axis of the arm hole 38. Thus, the spring 40 serves as the means to attach the lower arm 24 to the hinge support 22, the means to rotate the lower arm to the deployed position, and the means to translate the lower arm into the retaining groove 36 to lock the lower arm in the deployed position.

Figure 3:
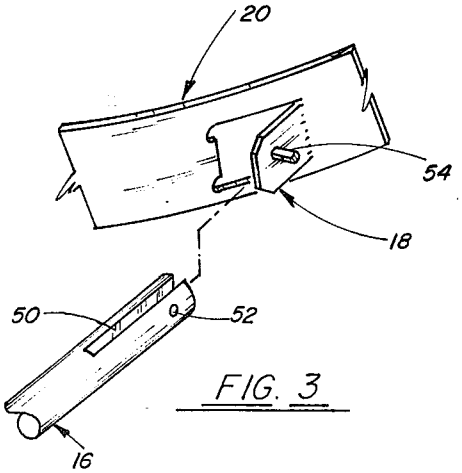
FIG. 3 is an exploded partial perspective view of the band and end of the upper arm of the deployment mechanism.

The upper arm 16 as shown in FIG. 3 has a slot 50 in the end which encompasses the tab 18. Transverse to the slot 50 is a hole 52. The tab 18 has an elliptical hole 54 at 45° to the vertical. The slot 50 fits about the tab 18, and is pivotably secured by a roll pin or other suitable means through the hole 52 and the elliptical hole 54.

In operation the staves 12 are positioned along the side of the central electronic unit 10 with the arms 16, 24 in a raised vertical position. A cylindrical shell (not shown) retains the staves 12 in this stowed position. Upon deployment the shell is removed by suitable means and the force of the spring 40 upon the lower arm 24 causes the arms 16, 24 to rotate to the deployed, horizontal position. When the lower arm 24 is fully deployed the force of the spring 40 also translates the middle portion 26 of the end of the lower arm into the retaining slot 36 of the hinge support 22, and the body 44 of the spring rests in the groove 48 under the hinge support body.

Thus, the present invention provides a deployment mechanism for a stave-like electronic array which is automatic upon release and which secures the elements in the deployed position.

What is claimed is:

1. A deployment mechanism for a circular electronic array having a plurality of staves comprising:

an upper arm pivotably attached at one end to the side of a central unit and at the other end to the upper portion of one of said staves;

a plurality of hinge supports secured to the bottom of said central unit;

a lower arm pivotably attached at one end to one of said hinge supports and at the other end to the lower portion of one of said staves; and spring means interacting between said lower arm and said hinge support for both automatically rotating said lower arm from a stowed position to a deployed position and for translating said lower arm so that said stave is locked in said deployed position.

2. A deployment mechanism as recited in claim 1 wherein said hinge support comprises a body having a retaining slot with an arm hole extending through said body from said retaining slot, the axis of said arm hole being orthogonal to said slot.

3. A deployment mechanism as recited in claim 2 wherein said rotating and translating spring means comprises a spring having an end part, a body part and an attachment part, said end part fitting over the end of said lower arm which protrudes from said arm hole opposite said retaining slot, said body part axially parallel with said end part but offset to lie under said hinge support body, and said attachment part being connected to said lower arm at a point on the retaining slot side of said body;

whereby when released said spring automatically rotates and translates said lower arm from said stowed to said deployed position, said lower arm being configured to fit in said retaining slot when in said deployed position.

4. A deployment mechanism as recited in claim 3 wherein said lower arm comprises:

a main section;

a mid-section integral with and orthogonal to said main section which fits within said retaining slot when in said deployed position; and an end section integral with said mid-section and orthogonal to both said mid-section and said main section, said end section protruding through said arm hole.

5. A deployment mechanism for a circular electronic array arranged around a central body comprising:

a hinge support attached to said central body;

an arm pivotally attached at one end to said hinge support and at the other end to an apparatus to be deployed; and spring means interacting between said hinge support and said arm for automatically rotating said arm from a first position to a second position, and for translating said arm so that said apparatus is locked in said second position.

6. A deployment mechanism as recited in claim 5 wherein said hinge support comprises a body having a retaining slot with an arm hole extending through said body from said retaining slot, the axis of said arm hole being orthogonal to said slot.

7. A deployment mechanism as recited in claim 6 wherein said rotating and translating spring means comprises a spring having an end part, a body part and an attachment part, said end part fitting over the end of said arm which protrudes from said arm hole opposite said retaining slot, said body part axially parallel with said end part but offset to lie under said hinge support body, and said attachment part being connected to said arm at a point on the retaining slot side of said body;

whereby when released said spring automatically rotates and translates said arm from said first to said second position, said arm being configured to fit in said retaining slot when in said second position.

8. A deployment mechanism as recited in claim 7 wherein said arm comprises:

a main section;

a mid-section integral with and orthogonal to said main section which fits within said retaining slot when in said second position; and an end section integral with said mid-section and orthogonal to both said mid-section and said main section, said end section protruding through said arm hole.

* * * * *